US011087697B2

(12) United States Patent
Ku et al.

(10) Patent No.: US 11,087,697 B2
(45) Date of Patent: Aug. 10, 2021

(54) SOURCE DRIVER AND OPERATING METHOD THEREOF

(71) Applicant: Raydium Semiconductor Corporation, Hsinchu (TW)

(72) Inventors: Tzong-Yau Ku, Hsinchu (TW); Jun-Ren Shih, Hsinchu (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 0 days.

(21) Appl. No.: 16/823,389

(22) Filed: Mar. 19, 2020

(65) Prior Publication Data

US 2020/0302879 A1 Sep. 24, 2020

(30) Foreign Application Priority Data

Mar. 21, 2019 (TW) ..... 108109784

(51) Int. Cl.
*G09G 3/36* (2006.01)
*G09G 3/3291* (2016.01)

(52) U.S. Cl.
CPC ..... *G09G 3/3291* (2013.01); *G09G 3/3685* (2013.01); *G09G 2310/0291* (2013.01)

(58) Field of Classification Search
CPC ..... G09G 3/3291; G09G 3/3685; G09G 2310/027; G09G 2310/0291; G09G 2320/0276; G09G 2340/0428; H03M 1/661; H03M 1/664; H03M 1/68
See application file for complete search history.

(56) References Cited

U.S. PATENT DOCUMENTS

2014/0176622 A1* 6/2014 Jung ..... G09G 3/3208 345/690
2015/0332638 A1* 11/2015 Li ..... G09G 3/3655 345/214
2016/0189615 A1* 6/2016 Kwon ..... G09G 3/3233 345/214
2016/0335951 A1* 11/2016 Ku ..... G09G 3/3688

* cited by examiner

*Primary Examiner* — Michael J Eurice

(57) ABSTRACT

A source driver including a digital-to-analog converter and an output buffer with an interpolation function is disclosed. A digital-to-analog converter converts a plurality of digital input voltages into a plurality of analog input voltages. The output buffer interpolates the analog input voltages. The output buffer outputs a first interpolated output voltage at a first time and a second interpolated output voltage at a second time respectively. A first interpolated voltage output curve of the first interpolated output voltage versus a digital input code and a second interpolated voltage output curve of the second interpolated output voltage versus the digital input code are both non-linear and opposite each other. The output buffer averages the first interpolated voltage output curve at the first time and the second interpolated voltage output curve at the second time to achieve a linear interpolated voltage characteristic.

12 Claims, 8 Drawing Sheets

SOURCE DRIVER AND OPERATING METHOD THEREOF

BACKGROUND OF THE INVENTION

1. Field of the Invention

The invention relates to a display; in particular, to a source driver and an operating method thereof.

2. Description of the Prior Art

In general, for organic light-emitting diode (OLED) display panels, there is a non-linear relationship between the light-emitting brightness and the voltage of the OLED, and the grayscale curve required by the customer is also generally non-linear (e.g., GAMMA 2.2).

It is assumed that the display driver uses a data mapping that converts 8-bit RGB information provided by the system into a 12-bit, and different data mapping settings are used to meet different requirements of the OLED display panels and customers. Therefore, the output of the display driver needs to be designed to have a high resolution.

However, if the display driver only uses a 12-bit digital-to-analog converter (DAC) to achieve high-resolution output, it needs a very large area, and each additional bit will consume more than double area of the DAC.

Therefore, in order to achieve the area saving effect, the display driver can choose to use an output buffer that can provide an interpolating function. As more bits are interpolated, higher resolution can be achieved with only a small increase in area.

However, as the number of bits to be interpolated increases, the non-linear problem caused by interpolation becomes more obvious. Taking FIG. 1 as an example, assuming that the number of bits used by the output buffer BF to interpolate voltages VA and VB is 4 bits, as shown in FIG. 2, the actual output voltage curve L1 is not only non-linear but also very different from the ideal linear relationship L2.

Therefore, the above-mentioned disadvantages of the prior arts need to be further improved.

SUMMARY OF THE INVENTION

Therefore, the invention provides a source driver and an operating method thereof to solve the above-mentioned problems occurred in the prior arts.

An embodiment of the invention is a source driver operating method. In this embodiment, the source driver operating method is used for operating a source driver including a digital-to-analog converter and an output buffer with an interpolation function. The source driver operating method includes steps of: the digital-to-analog converter converting a plurality of digital input voltages into a plurality of analog input voltages; the output buffer interpolating the plurality of analog input voltages, the output buffer outputting a first interpolated output voltage at a first time and outputting a second interpolated output voltage at a second time respectively, wherein a first interpolated voltage output curve of the first interpolated output voltage versus a digital input code and a second interpolated voltage output curve of the second interpolated output voltage versus the digital input code are both non-linear and opposite each other; and the output buffer averaging the first interpolated voltage output curve at the first time and averaging the second interpolated voltage output curve at the second time to achieve a linear interpolated voltage characteristic.

In an embodiment, the first interpolated voltage output curve and the second interpolated voltage output curve are offset relative to each other by a plurality of digital input codes.

In an embodiment, the first interpolated voltage output curve and the second interpolated voltage output curve are offset relative to each other by a specific voltage.

In an embodiment, the first interpolated voltage output curve and the second interpolated voltage output curve are offset relative to each other by a plurality of digital input codes and a specific voltage.

In an embodiment, the first interpolated voltage output curve and the second interpolated voltage output curve are offset relative to each other according to a mapping table to achieve the linear interpolated voltage characteristic.

In an embodiment, the first interpolated voltage output curve and the second interpolated voltage output curve are offset relative to each other one time or a plurality of times.

Another embodiment of the invention is a source driver. In this embodiment, the source driver includes a digital-to-analog converter and an output buffer with an interpolation function. The digital-to-analog converter is configured to convert a plurality of digital input voltages into a plurality of analog input voltages. The output buffer is coupled to the digital-to-analog converter and configured to output a first interpolated output voltage at a first time and output a second interpolated output voltage at a second time respectively, wherein a first interpolated voltage output curve of the first interpolated output voltage versus a digital input code and a second interpolated voltage output curve of the second interpolated output voltage versus the digital input code are both non-linear and opposite each other. The output buffer is configured to average the first interpolated voltage output curve at the first time and the second interpolated voltage output curve at the second time to achieve a linear interpolated voltage characteristic.

Compared with the prior art, the source driver and the operating method thereof according to the invention are obtained by averaging interpolated voltage output curves that are opposite to each other at different times by a time-mixing method to obtain the interpolated voltage characteristics very close to linear characteristics.

Therefore, the source driver and the operation method thereof according to the invention not only have the advantages of achieving higher resolution with only a small increase in area in the prior art, but also provide a interpolated voltage that is very close to linear characteristics to effectively improve the non-linear problems caused by interpolation in the prior art.

In particular, the average interpolation voltage output curve obtained by averaging different interpolation voltage output curves obtained by performing a variety of different offsets is closer to an ideal linear relationship, so that the non-linear problems due to interpolation can be improved more effectively.

The advantage and spirit of the invention may be understood by the following detailed descriptions together with the appended drawings.

BRIEF DESCRIPTION OF THE APPENDED DRAWINGS

DETAILED DESCRIPTION OF THE INVENTION

An embodiment of the invention is a source driver operating method. In this embodiment, the source driver operating method is used to operate a source driver in a display device. The source driver can be coupled to an organic light-emitting diode (OLED) display panel, but not limited to this. The source driver includes a digital-to-analog converter and an output buffer with interpolation function.

Figure 1:
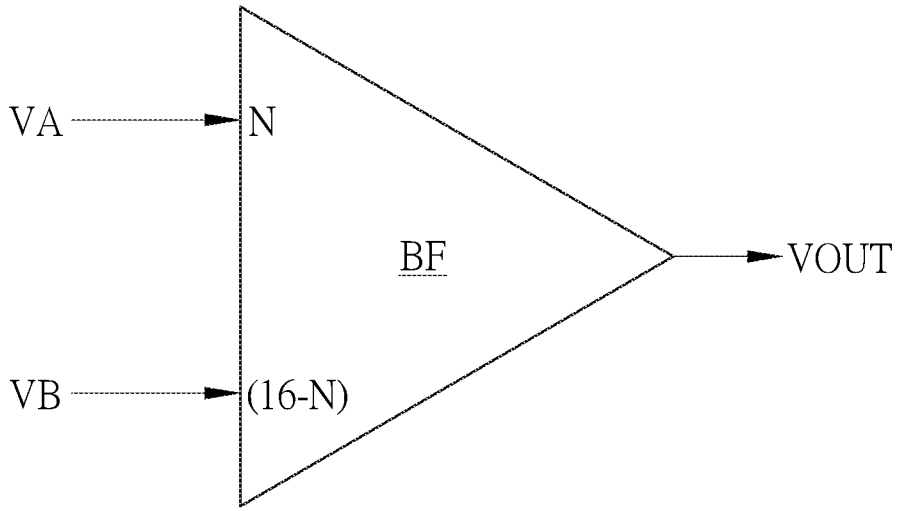
FIG. 1 (PRIOR ART)
FIG. 1 is a schematic diagram showing that the conventional output buffer BF performs a 4-bit interpolation on the voltages VA and VB.
Figure 2:
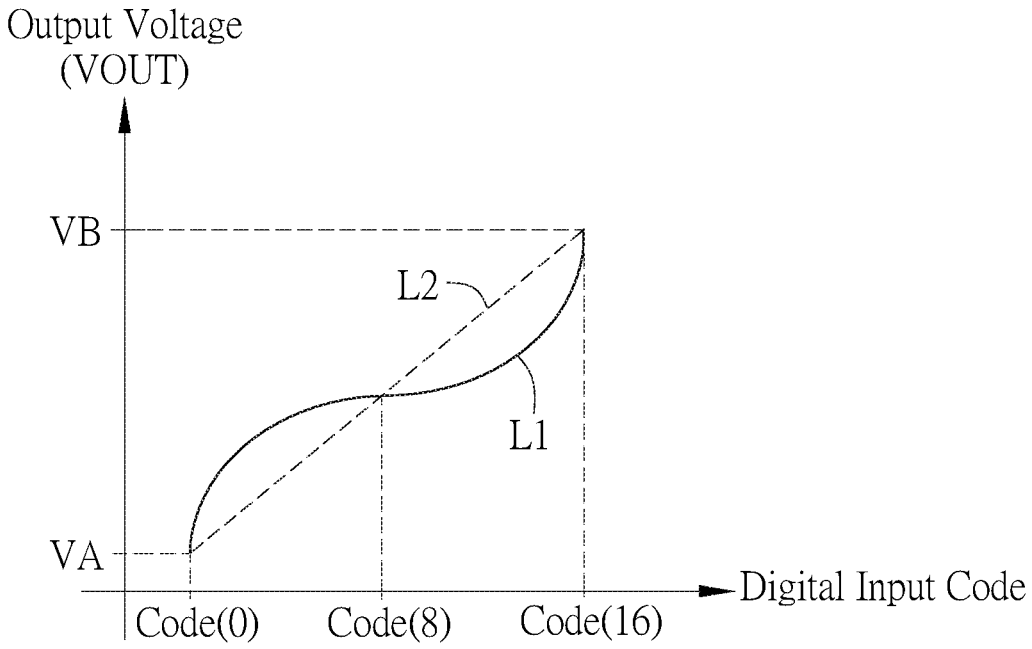
FIG. 2 (PRIOR ART)
FIG. 2 is a schematic diagram showing that the actual output voltage curve L1 obtained after the 4-bit interpolation of FIG. 1 is not only non-linear, but is quite different from the ideal linear relationship L2.
Figure 3:
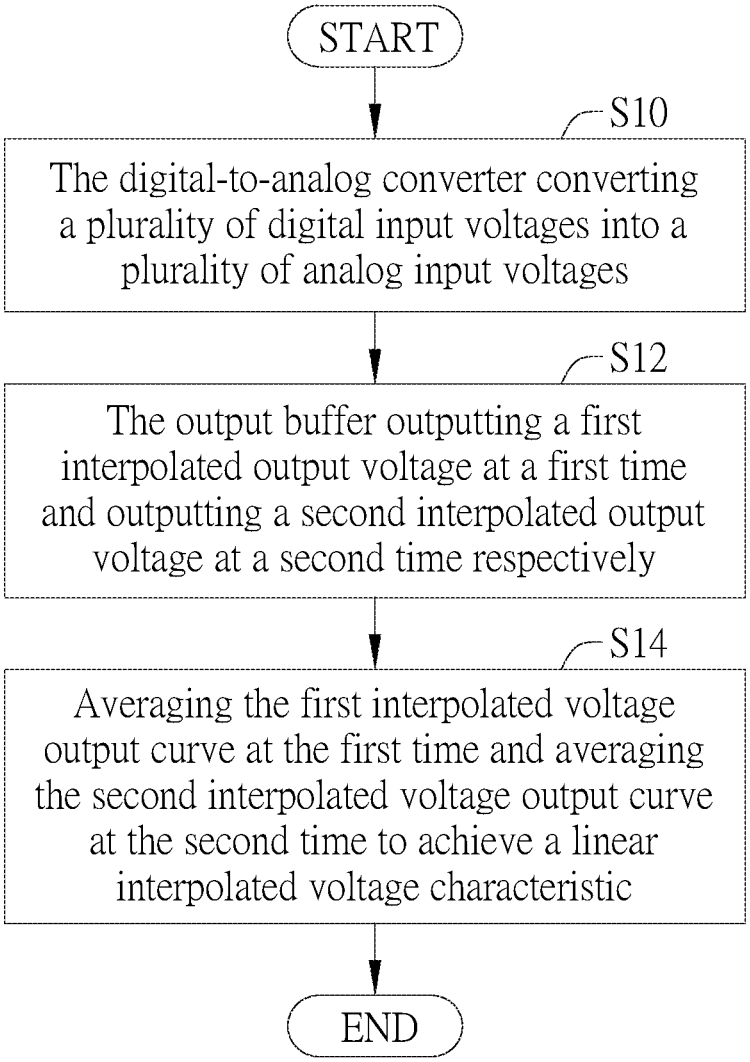
FIG. 3 is a flowchart showing the source driver operating method according to a preferred embodiment of the invention.

Please refer to FIG. 3. FIG. 3 is a flowchart showing the source driver operating method of this embodiment.

As shown in FIG. 3, the source driver operation method includes the following steps of:

Step S10: the digital-to-analog converter converts a plurality of digital input voltages into a plurality of analog input voltages, and the output buffer performs interpolation on the plurality of analog input voltages;

Step S12: the output buffer outputs a first interpolated output voltage at a first time and outputs a second interpolated output voltage at a second time respectively, wherein the first interpolated voltage output curve of the first interpolated output voltage vs. the digital input code and the second interpolated voltage output curve of the second interpolated output voltage vs. the digital input code are both non-linear and opposite to each other; and Step S14: the first interpolated voltage output curve at the first time and the second interpolated voltage output curve at the second time are averaged to achieve a linear interpolated voltage characteristic.

Figure 4:
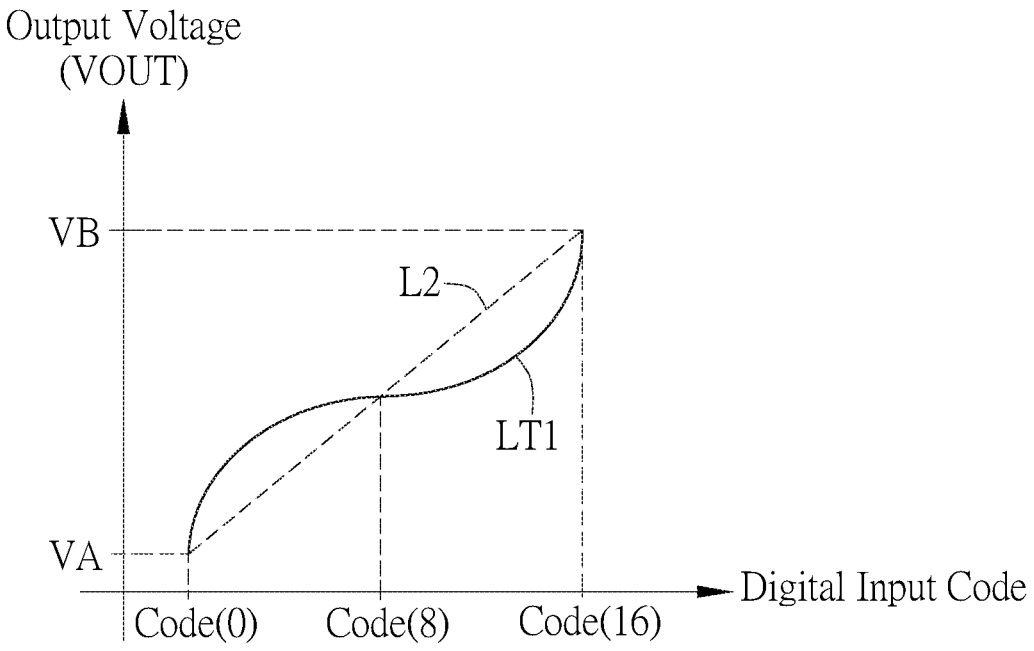
FIG. 4 is a schematic diagram showing the first interpolated voltage output curve LT1 of the first interpolated output voltage vs. the digital input code at a first time.
Figure 5:
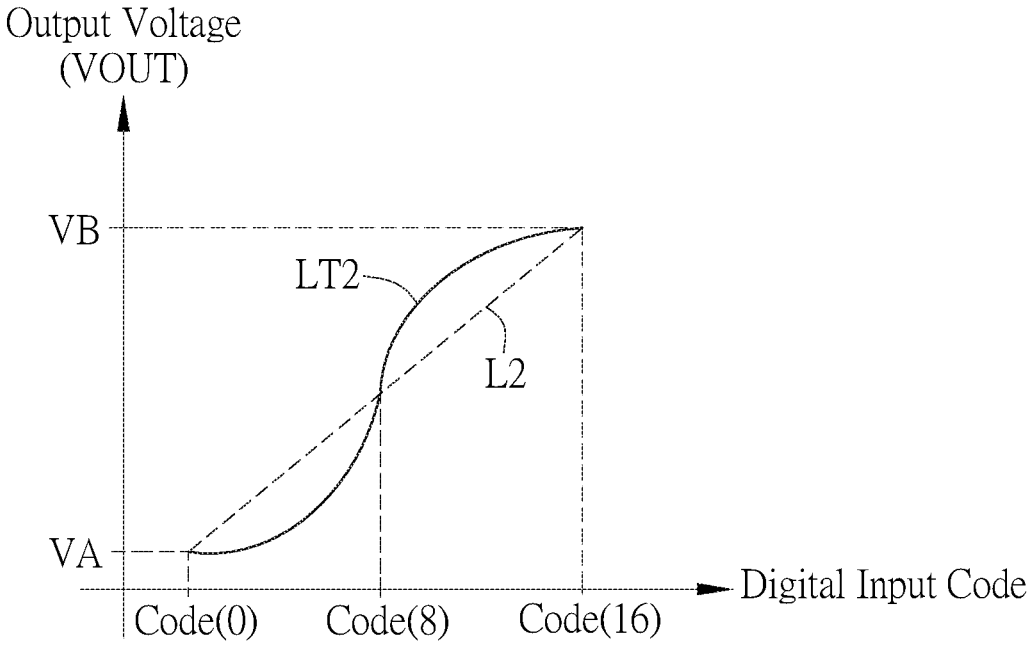
FIG. 5 is a schematic diagram showing the second interpolated voltage output curve LT2 of the second interpolated output voltage vs. the digital input code at a second time.

Please refer to FIG. 4 and FIG. 5. FIG. 4 and FIG. 5 show schematic diagrams of the first interpolated voltage output curve LT1 of the first interpolated output voltage vs. the digital input code at the first time and the second interpolated voltage output curve LT2 of the second interpolated output voltage vs. the digital input code at the second time respectively.

According to FIG. 4 and FIG. 5, it can be known that the first interpolated voltage output curve LT1 of the first interpolated output voltage vs. the digital input code and the second interpolated voltage output curve LT2 of the second interpolated output voltage vs. the digital input code generated by the step S12 are both non-linear and opposite to each other.

Figure 6:
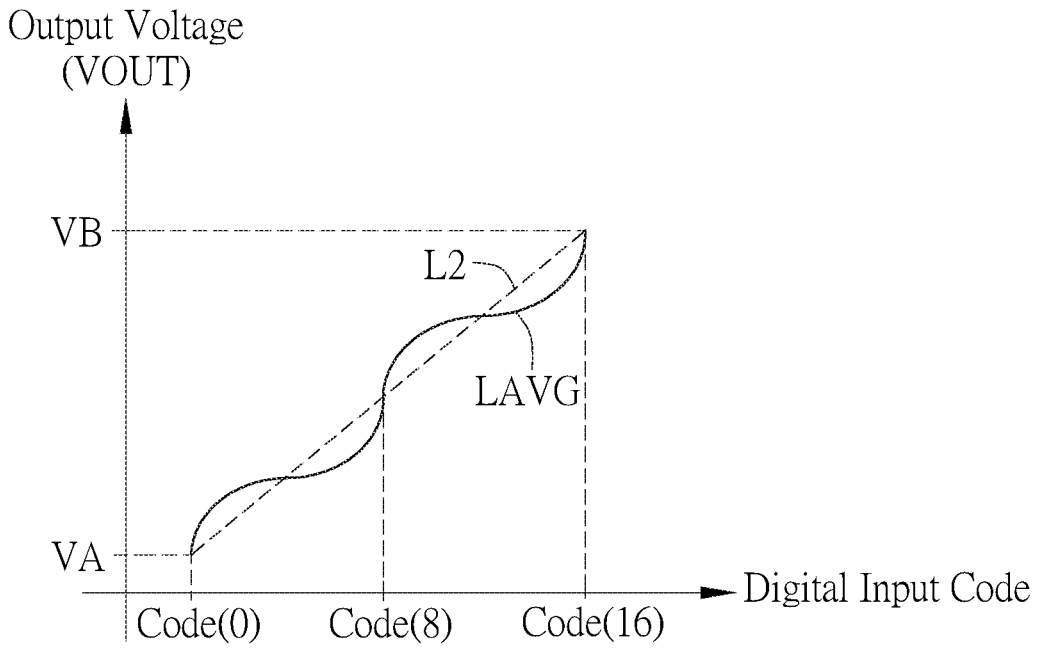
FIG. 6 is a schematic diagram showing the average interpolated voltage output curve LAVG which is closer to the ideal linear relationship L2 after averaging the first interpolated voltage output curve LT1 of FIG. 4 and the second interpolated voltage output curve LT2 of FIG. 5.

Next, as shown in FIG. 6, when the first interpolated voltage output curve LT1 of FIG. 4 and the second interpolated voltage output curve LT2 of FIG. 5 are averaged by the step S14, the average interpolated voltage output curve LAVG is obtained. And, the average interpolated voltage output curve LAVG will be closer to the ideal linear relationship L2 than the first interpolated voltage output curve LT1 and the second interpolated voltage output curve LT2.

It should be noted that as long as the different interpolated voltage output curves generated at different times in the step S12 are non-linear and opposite to each other, when the different interpolated voltage output curves are averaged in the step S14, a better average interpolated voltage output curve can be obtained accordingly.

In addition, at the first time and the second time, the method can use each display line, every multiple display lines, each display frame or every multiple display frames to switch independently or simultaneously without specific limitations.

In practical applications, the first interpolated voltage output curve LT1 and the second interpolated voltage output curve LT2 can be offset relative to each other by a plurality of digital input codes and/or a specific voltage value, and the first interpolated voltage output curve LT1 and the second interpolated voltage output curve LT2 can be offset relative to each other one time or a plurality of times without specific limitations.

In addition, the first interpolated voltage output curve LT1 and the second interpolated voltage output curve LT2 can be relatively offset from each other according to a default mapping table to achieve linear interpolated voltage characteristics.

Figure 7:
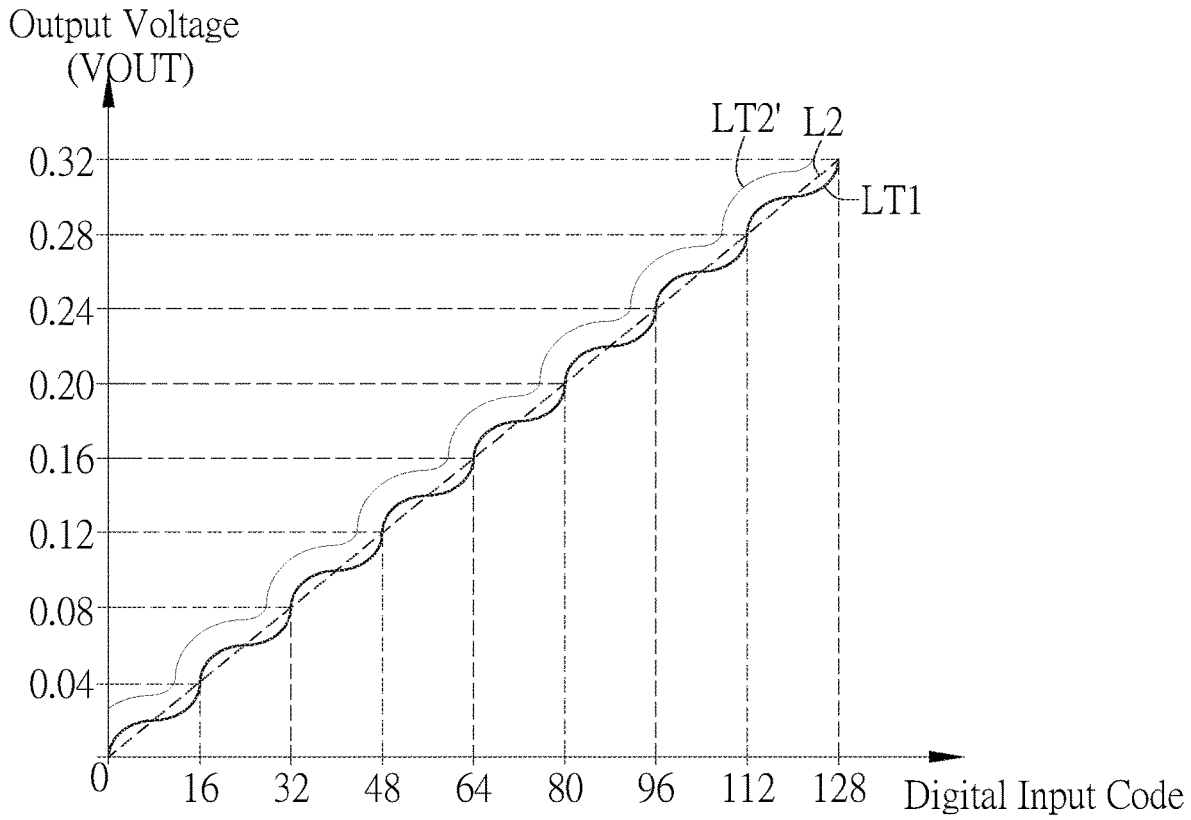
FIG. 7 is a schematic diagram showing an interpolated voltage output curve LT2' formed by shifting the first interpolated voltage output curve LT1 at the first time upward by 8-level voltage.
Figure 8:
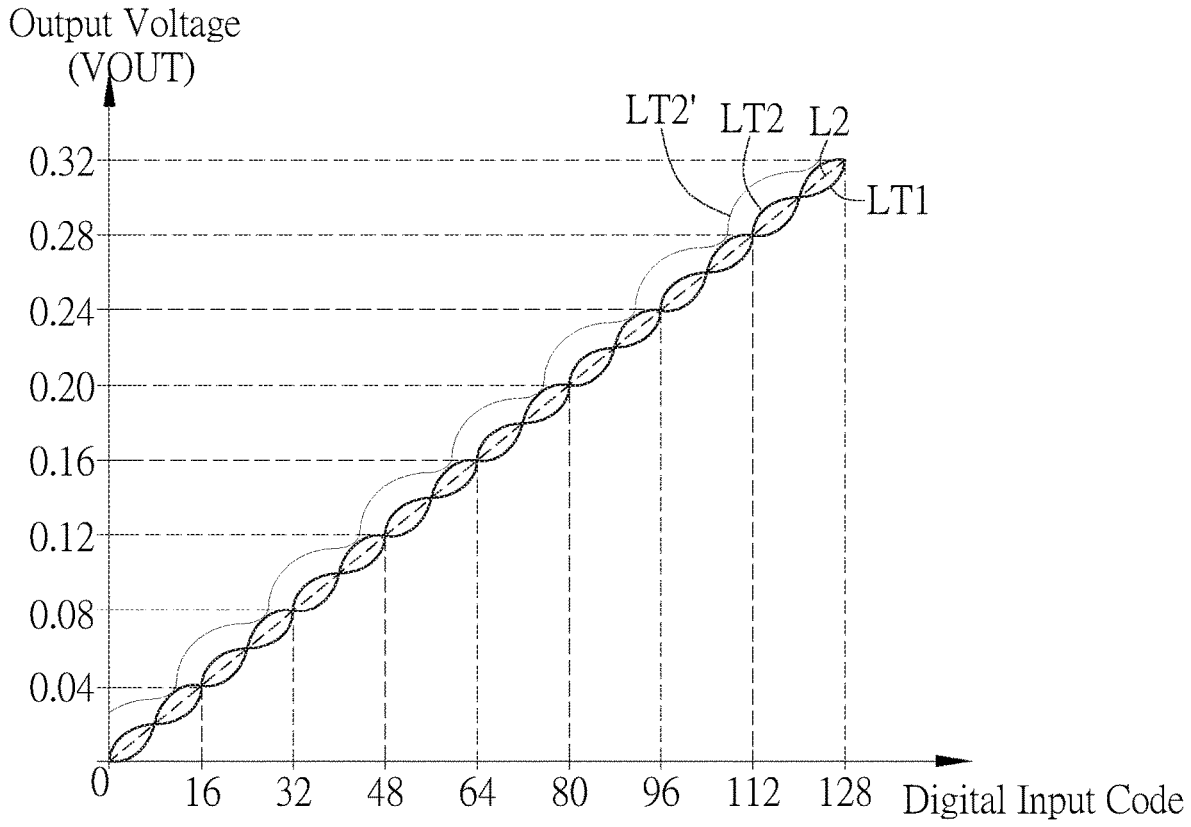
FIG. 8 is a schematic diagram showing that the interpolated voltage output curve LT2' is further shifted to the right by 8 digital input codes to form the second interpolation voltage output curve LT2.

For example, as shown in FIG. 7, if the first interpolated voltage output curve LT1 at the first time is shifted upward by a 8-level voltage, the interpolated voltage output curve LT2' can be obtained; then, as shown in FIG. 8, if the interpolated voltage output curve LT2' is further shifted to the right by 8 digital input codes, a second interpolated voltage output curve LT2 can be obtained. Since the first interpolated voltage output curve LT1 and the second interpolated voltage output curve LT2 are roughly symmetrical with the ideal linear relationship L2, this method averages the first interpolated voltage output curve LT1 and the second interpolated voltage output curve LT2 to obtain the average interpolated voltage output curve will approach the ideal linear relationship L2.

It should be noted that when this method averages different interpolated voltage output curves obtained by performing more different offsets, the obtained average interpolated voltage output curve will be closer to the ideal linear relationship. Therefore, the non-linear problems caused by interpolation can be improved more effectively.

For example, it is assumed that ORG represents the original unshifted interpolated voltage output curve; SH4 represents the average interpolated voltage output curve obtained by shifting a 4-level voltage and then averaging; SH8 represents the average interpolated voltage output curve obtained by shifting a 8-level voltage and then averaging; SH12 represents the average interpolated voltage output curve obtained by shifting a 12-level voltage and then averaging; AVG (ORG+SH8) represents the average interpolated voltage output curve obtained by averaging the original interpolated voltage output curve ORG and the 8-level voltage shifted average interpolated voltage output curve SH8; AVG (ORG+SH4+SH8+SH12) represents the average interpolated voltage output curve obtained by averaging the original interpolated voltage output curve ORG, the 4-level voltage shifted average interpolated voltage output curve SH4, the 8-level voltage shifted average interpolated voltage output curve SH8 and the 12-level voltage shifted average interpolated voltage output curve SH12.

Figure 9:
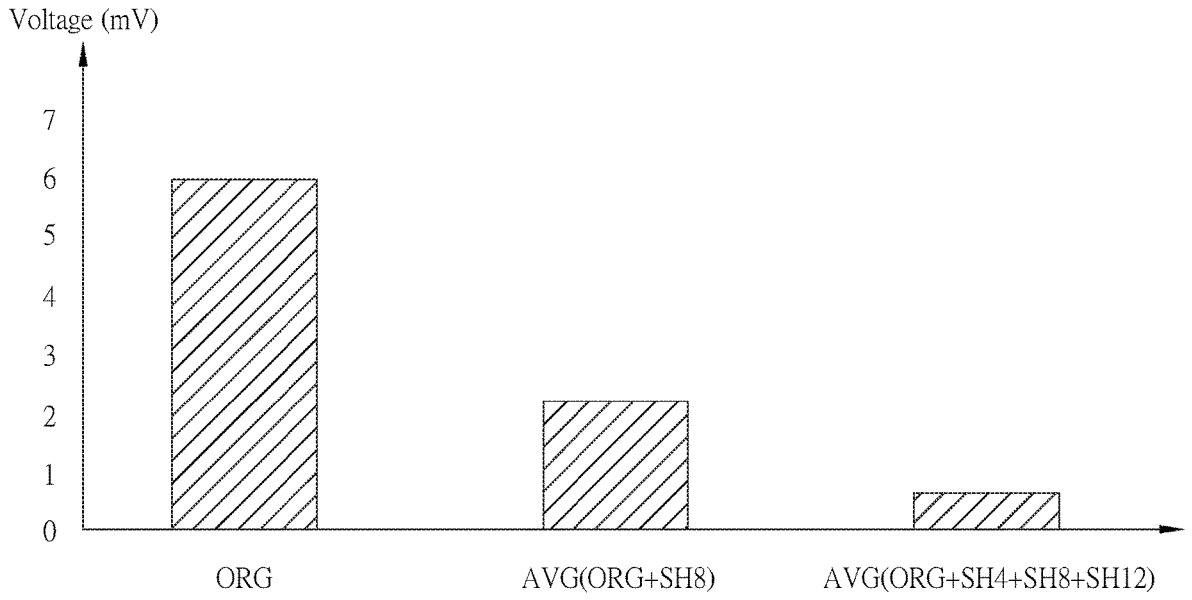
FIG. 9 is a schematic diagram showing that the interpolated voltage output curve obtained by performing more different offsets can improve the non-linear problem caused by interpolation more effectively.

According to FIG. 9, the maximum voltage difference between the average interpolated voltage output curve AVG (ORG+SH8) and the ideal linear relationship will be about 63% smaller than the maximum voltage difference between the original interpolated voltage output curve ORG and the ideal linear relationship. The voltage difference is reduced by; the maximum voltage difference between the average interpolated voltage output curve AVG (ORG+SH4+SH8+SH12) and the ideal linear relationship will be 89% smaller than the maximum voltage difference between the original interpolated voltage output curve ORG and the ideal linear relationship.

That is to say, the average interpolated voltage output curve AVG (ORG+SH8) obtained according to the original interpolated voltage output curve ORG and the 8-level voltage shifted average interpolated voltage output curve SH8 will be closer to the ideal linear relationship than the original interpolated voltage output curve ORG, and the average interpolated voltage output curve AVG (ORG+SH4+SH8+SH12) obtained according to the original interpolated voltage output curve ORG and the average interpolated voltage output curves SH4, SH8 and SH12 shifted by 4-level voltage, 8-level voltage and 12-level voltage will be closer to the ideal linear relationship than the average interpolated voltage output curve AVG (ORG+SH8). The rest can be deduced by analogy and will not be repeated here.

From the above-mentioned experimental results, it can be known that after the source driver operating method of the invention averages the interpolated voltage output curves opposite to each other at different times by a time-mixing method, it can greatly improve the non-linear problems due to interpolation in the prior arts and provide an interpolated voltage characteristics very close to linear.

Another embodiment according to the invention is a source driver. In this embodiment, the source driver is disposed in the display device, and the source driver can be coupled to the OLED display panel, but not limited to this.

Figure 10:
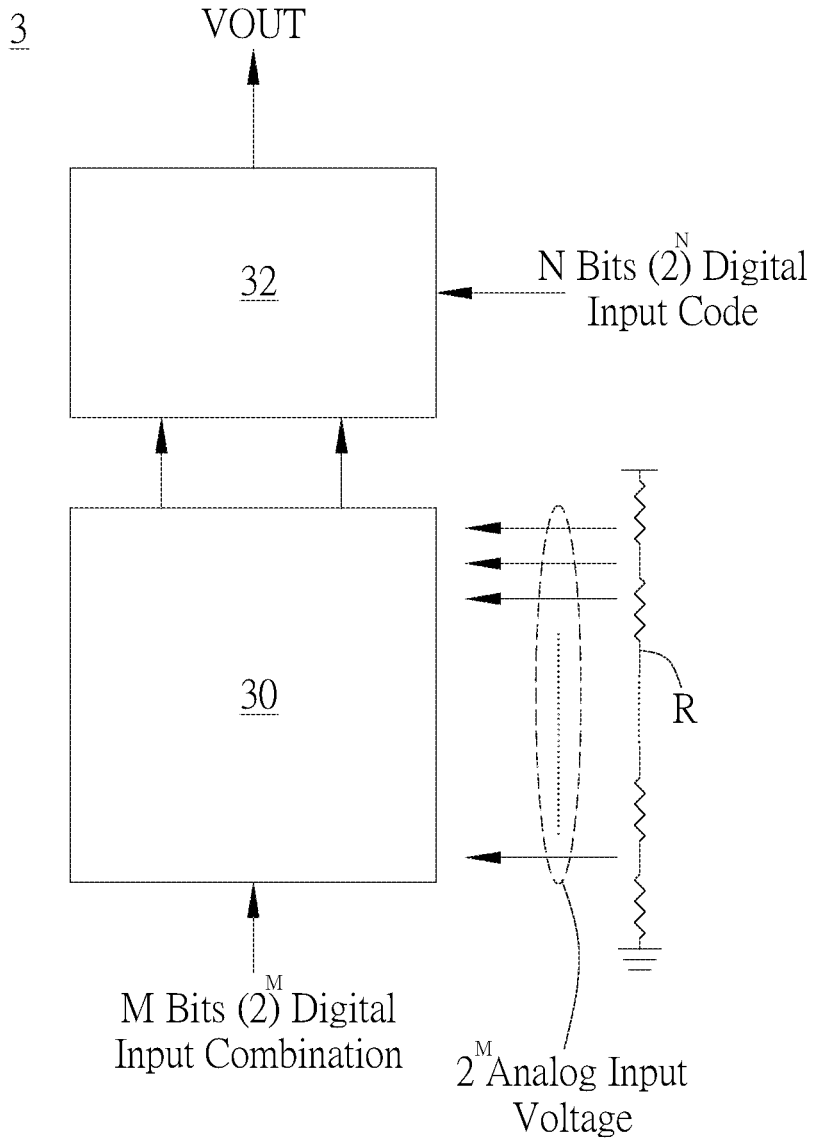
FIG. 10 is a schematic diagram of a source driver according to another preferred embodiment of the invention.

Please refer to FIG. 10. FIG. 10 is a schematic diagram showing the source driver in this embodiment. As shown in FIG. 10, the source driver 3 includes a digital-to-analog converter 30 and an output buffer 32. The digital-to-analog converter 30 is coupled to the output buffer 32. The digital-to-analog converter 30 is configured to convert a digital input voltage into an analog input voltage.

The output buffer 32 has an interpolation function and outputs a first interpolated output voltage at a first time and a second interpolated output voltage at a second time respectively. The first interpolated voltage output curve of the first interpolated output voltage vs. the digital input code and the second interpolated voltage output curve of the second interpolated output voltage vs. the digital input code are both non-linear and opposite to each other. The output buffer 32 averages the first interpolated voltage output curve at the first time and the second interpolated voltage output curve at the second time to achieve a linear interpolated voltage characteristic.

Compared with the prior art, the source driver and the operating method thereof according to the invention are obtained by averaging interpolated voltage output curves that are opposite to each other at different times by a time-mixing method to obtain the interpolated voltage characteristics very close to linear characteristics.

Therefore, the source driver and the operation method thereof according to the invention not only have the advantages of achieving higher resolution with only a small increase in area in the prior art, but also provide a interpolated voltage that is very close to linear characteristics to effectively improve the non-linear problems caused by interpolation in the prior art.

In particular, the average interpolation voltage output curve obtained by averaging different interpolation voltage output curves obtained by performing a variety of different offsets is closer to an ideal linear relationship, so that the non-linear problems due to interpolation can be improved more effectively.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A source driver operating method, for operating a source driver comprising a digital-to-analog converter and an output buffer with an interpolation function, comprising steps of:

the digital-to-analog converter converting a plurality of digital input voltages into a plurality of analog input voltages;

the output buffer interpolating the plurality of analog input voltages to generate a first interpolated output voltage at a first time and to generate a second interpolated output voltage at a second time respectively, wherein a first interpolated voltage output curve of the first interpolated output voltage versus a digital input code and a second interpolated voltage output curve of the second interpolated output voltage versus the digital input code are both non-linear and opposite each other; and the output buffer averaging the first interpolated voltage output curve at the first time and averaging the second interpolated voltage output curve at the second time to achieve a linear interpolated voltage characteristic;

wherein the first interpolated output voltage curve exists at the first time and the second interpolated output voltage curve exists at the second time; the first interpolated output voltage curve and the second interpolated output voltage curve are substantially reflections of each other about a line described by a perfectly linear input-to-output response for the digital-to-analog converter; the source driver is coupled to an OLED display panel, and voltages at the first interpolated voltage output curve and the second interpolated voltage output curve are positive voltages.

2. The source driver operating method of claim 1, wherein the first interpolated voltage output curve and the second interpolated voltage output curve are offset relative to each other by a plurality of digital input codes.

3. The source driver operating method of claim 1, wherein the first interpolated voltage output curve and the second interpolated voltage output curve are offset relative to each other by a specific voltage.

4. The source driver operating method of claim 1, wherein the first interpolated voltage output curve and the second interpolated voltage output curve are offset relative to each other by a plurality of digital input codes and a specific voltage.

5. The source driver operating method of claim 1, wherein the first interpolated voltage output curve and the second interpolated voltage output curve are offset relative to each other according to a mapping table to achieve the linear interpolated voltage characteristic.

6. The source driver operating method of claim 1, wherein the first interpolated voltage output curve and the second interpolated voltage output curve are offset relative to each other one time or a plurality of times.

7. A source driver, comprising:

a digital-to-analog converter, configured to convert a plurality of digital input voltages into a plurality of analog input voltages; and an output buffer with an interpolation function, coupled to the digital-to-analog converter, configured to interpolate the plurality of analog input voltages to generate a first interpolated output voltage at a first time and generate a second interpolated output voltage at a second time respectively, wherein a first interpolated voltage output curve of the first interpolated output voltage versus a digital input code and a second interpolated voltage output curve of the second interpolated output voltage versus the digital input code are both non-linear and opposite each other; the output buffer is configured to average the first interpolated voltage output curve at the first time and the second interpolated voltage output curve at the second time to achieve a linear interpolated voltage characteristic;

wherein the first interpolated output voltage curve exists at the first time and the second interpolated output voltage curve exists at the second time; the first interpolated output voltage curve and the second interpolated output voltage curve are substantially reflections of each other about a line described by a perfectly linear input-to-output response for the digital-to-analog converter; the source driver is coupled to an OLED display panel, and all voltages at the first interpolated voltage output curve and the second interpolated voltage output curve are positive voltages.

8. The source driver of claim 7, wherein the first interpolated voltage output curve and the second interpolated voltage output curve are offset relative to each other by a plurality of digital input codes.

9. The source driver of claim 7, wherein the first interpolated voltage output curve and the second interpolated voltage output curve are offset relative to each other by a specific voltage.

10. The source driver of claim 7, wherein the first interpolated voltage output curve and the second interpolated voltage output curve are offset relative to each other by a plurality of digital input codes and a specific voltage.

11. The source driver of claim 7, wherein the first interpolated voltage output curve and the second interpolated voltage output curve are offset relative to each other according to a mapping table to achieve the linear interpolated voltage characteristic.

12. The source driver of claim 7, wherein the first interpolated voltage output curve and the second interpolated voltage output curve are offset relative to each other one time or a plurality of times.

* * * * *